US006201482B1

(12) United States Patent
Schiefele et al.

(10) Patent No.: US 6,201,482 B1
(45) Date of Patent: Mar. 13, 2001

(54) METHOD OF DETECTING A COLLISION RISK AND PREVENTING AIR COLLISIONS

(75) Inventors: Jens Schiefele, Wiesbaden; Richard Schulze, Darmstadt; Harro von Viebahn, Gross-Bieberau, all of (DE)

(73) Assignee: VDO Luftfahrtgeraete Werk GmbH (DE)

( * ) Notice: Subject to any disclaimer, the term of this patent is extended or adjusted under 35 U.S.C. 154(b) by 0 days.

(21) Appl. No.: 09/142,817

(22) PCT Filed: Mar. 7, 1997

(86) PCT No.: PCT/DE97/00484

§ 371 Date: Jan. 11, 1999

§ 102(e) Date: Jan. 11, 1999

(87) PCT Pub. No.: WO97/34276

PCT Pub. Date: Sep. 18, 1997

(30) Foreign Application Priority Data

Mar. 12, 1996 (DE) ..... 196 09 613

(51) Int. Cl.[7] ..... G08G 5/04

(52) U.S. Cl. ..... 340/961; 340/963; 340/964; 701/301; 701/302

(58) Field of Search ..... 340/961, 963, 340/964; 701/301, 9, 14, 302

(56) References Cited

U.S. PATENT DOCUMENTS 4,224,669 * 9/1980 Brame ..... 364/433
4,782,450 * 11/1988 Flax ..... 364/461
4,839,658 * 6/1989 Kathol et al. ..... 342/455
4,914,733 * 4/1990 Granick ..... 340/961
5,008,844 * 4/1991 Kyriakos et al. ..... 364/571.05
5,111,400 * 5/1992 Yoder ..... 364/424.01
5,179,377 * 1/1993 Hancock ..... 340/961
5,420,582 * 5/1995 Kubbat et al. ..... 340/974
5,442,556 * 8/1995 Boyles et al. ..... 364/433
5,636,123 * 6/1997 Rich et al. ..... 364/461
5,861,846 * 1/1999 Minter ..... 342/443
5,872,526 * 2/1999 Tognazzini ..... 340/961
5,945,926 * 8/1999 Ammar et al. ..... 340/970

FOREIGN PATENT DOCUMENTS

WO9528650 10/1995 (WO) .

* cited by examiner

*Primary Examiner*—Daniel J. Wu
*Assistant Examiner*—Toan Pham
(74) *Attorney, Agent, or Firm*—Milde, Hoffberg & Macklin, LLP

(57) ABSTRACT

In a method of detecting a collision risk and preventing air collisions, it is proposed that probabilities should be calculated for the likely presence of one's own aircraft in predetermined sectors at a number of selected times (probabilities of presence) and these probabilities for one's own aircraft and those for other objects should be used to calculate the probabilities of one's own aircraft and at least one of the other objects being present simultaneously in a given sector (probabilities of collision) for the predetermined sectors and selected times.

18 Claims, 10 Drawing Sheets t = t1 t = t1 + n•δt t = t1

$t = t1 + n \cdot \delta t$ $V_A$ Airspeed
$V_G$ Groundspeed
$V_W$ Windspeed
$V_{VS}$ Vertical Speed
p Position $\psi_H$ Heading
$\psi_T$ Track
$\dot{\psi}$ Heading Rate
$\gamma$ Flightpath Angle
Index i : intruder aircraft
Index 0 : own aircraft

METHOD OF DETECTING A COLLISION RISK AND PREVENTING AIR COLLISIONS

BACKGROUND OF THE INVENTION

This invention relates to procedures for identifying a risk of a collision and for avoiding collisions in aviation.

The TCASII (Traffic Collision Avoidance System) for the avoidance of collisions has become known and is described, for example, in the FAA Document, Reprint by BFS, "TCASII System Description", Washington, D.C., USA 1993. The equipping of all aircraft comprising more than thirty seats which are authorised in the USA with this system has been prescribed in the USA since 1993. It provides the pilots of aircraft with a direct warning of possible conflicts with other aircraft in the vicinity. Independently of the ground control and of the visibility conditions, the pilot of the aircraft is provided with the possibility of recognising potential conflicts in good time and of reacting to them. The algorithm which forms the basis of TCASII is not intended for the purpose of controlling normal aviation traffic. It is simply intended to avoid a collision in the event of inappropriate behaviour by aviation participants or by ground control.

This algorithm is based on the TAU criterion, which determines the relative time of approach of two aircraft up to the time of the nearest approach. For this purpose, the transponders of the aircraft involved are repeatedly and actively interrogated. The time to the furthest approach is then calculated for constant flying behaviour. If a defined time threshold up to the furthest approach is undershot, the system reacts and proposes a vertical evasive manoeuvre to the pilot of the aircraft.

In the vicinity of the ground, the operation of TCAS is limited, and TCAS cannot be used for traffic taxiing on the ground. Moreover, vertical evasive manoeuvres are not in accordance with recognised evasive rules. For the vertical evasive manoeuvres which are proposed, there is the risk of flying through other flying levels and of endangering other participants in air traffic.

The underlying object of the procedure according to the invention is to provide the pilot with a visualisation, in an illustrative manner, of conflict potentials which actually exist, so that the pilot can make safe decisions regarding evasive routes. Apart from the detection of the conflict potential which actually exists, the object is also to make possible the automatic proposal of evasive routes without further risks arising at the same time.

In one procedure for identifying a risk of a collision, the object according to the invention is achieved in that for each aircraft concerned, probabilities are calculated with which the aircraft will be situated in predetermined space elements at a plurality of selected times (occupancy probabilities), and that from the occupancy probabilities of the aircraft concerned and the occupancy probabilities of other objects, the probabilities of the simultaneous occupancy of each space element by the aircraft concerned and by at least one of the other objects (collision probabilities) are calculated for the predetermined space elements and the selected times.

SUMMARY OF THE INVENTION

Like the known TCASII procedure, the aim of the procedure according to the invention is not to control normal air traffic, but is simply to avoid a collision and to assist the selection of an evasive route in the event of inappropriate behaviour by the pilots of aircraft or by ground control, or if there is a lack of ground control.

The procedure according to the invention has the advantage that the anticipated behaviour of more than two aircraft involved is taken into consideration, and that there is no danger to third parties, particularly if all aircraft involved are equipped with devices for carrying out the procedure according to the invention.

In the procedure according to the invention, it is possible to provide the pilot of the aircraft with a display of the risk potentials which is easily recorded. In particular, this can be effected by a graphical display of the space elements, with the occupancy probability of the aircraft concerned and that of the other objects which are calculated each time, on a display device, and/or by displaying, in emphasised form, space elements for which the collision probability exceeds a predetermined value.

Moreover, for the avoidance of collisions by the procedure according to the invention, an evasive route for the aircraft concerned can be calculated and displayed if for at least one space element the probability of simultaneous occupancy by the particular object and by at least one other object exceeds a predetermined value.

One advantageous embodiment facilitates a particularly favourable calculation of an evasive route by calculating a plurality of evasive routes, with an excursion which increases from evasive route to evasive route, as a test in accordance with recognised or determined evasive rules, by selecting and displaying the calculated evasive route which gives a probability of a hazardous encounter below a predetermined threshold value at the smallest excursion or by converting it into a control command, and, when a limiting excursion is reached without the probability of a hazardous encounter being correspondingly reduced, by calculating evasive routes in another direction.

In order to identify the risk of collision with other aircraft, provision is made in the procedure according to the invention for occupancy probabilities to be calculated for other aircraft which are situated within a relevant distance.

According to another embodiment of the invention, provision is made for fixed objects on the ground to be taken into consideration with an occupancy probability of 1 for the display of the space elements and/or for the calculation of evasive routes. These objects, for example buildings or elevations on the ground, can be stored in a database and can be retrieved in each case for an air space which is to be considered.

The procedure according to the invention can thus be designed in such a way that it operates purely as a traffic collision avoidance system without a database for fixed objects on the ground, or so that it determines risks of collisions on the ground and in the air using a database. Finally, a design as a ground collision avoidance system is also possible, in which other aircraft situated in the air are not recorded.

The procedure according to the invention also has the advantage that it can also be used for movements on the ground for the avoidance of hazardous encounters or collisions, wherein fixed obstacles are stored in a database and motor vehicles can be treated similarly to other aircraft.

The space elements themselves can assume various forms. However, an embodiment which is advantageous for the individual calculations provides for the space elements to be in the form of a parallelepipeds.

In another embodiment of the procedure according to the invention, the size of the space elements is variable, wherein the size increases with increasing flying height. In this connection, provision is preferably made for it to be possible to vary the size of the space elements within three classes, namely the smallest space elements for taxiing on the ground, medium space elements for flying heights less than 10,000 feet, and large space elements for greater flying heights. Thus the size of the space elements is matched to the prevailing speed in each case and to the accuracy of distance which is necessary due to the density of traffic.

One advantageous embodiment of the procedure according to the invention consists of calculating probabilities—hereinafter also called occupancy probabilities—from the respective position, course and course over the ground of the aircraft, from the flying speed and the speed over the ground, and from the speed of changing course and the speed of ascent/descent, wherein a multiplicity of calculations is made with variations of the flying speed, of the speed of changing course and of the speed of ascent/descent. In particular, provision is made at the same time for the values of the flying speed, of the speed of changing course and of the speed of ascent/descent which are assumed for the calculation of occupancy probabilities to be statistically varied, and for each of these variations for counters to be incremented for those space elements in which the aircraft is situated at the selected times.

The flying behaviour of the aircraft concerned can be taken into consideration for the statistical variation of the speeds. For example, a higher inertia and thus a lesser change in flying speed can be assumed for jumbo jet aircraft compared with combat aircraft, for example.

Another advantageous embodiment of the procedure according to the invention consists of calculating the probabilities from the respective position, course and course over the ground of the aircraft, from the flying speed and from the speed over the ground, from the speed of changing course and from the speed of ascent/descent, wherein measures are also put into effect for the statistical scatter of the flying speed, of the speed of changing course and of the speed of ascent/descent, so that at each selected time a statistical distribution of the positions of the aircraft is calculated, and the statistical distributions are converted into occupancy probabilities in individual space elements. Various analytical computational procedures are available for performing this calculation.

In the procedure according to the invention, provision is advantageously made for the data on other aircraft which are necessary for calculating probabilities to be measured in the other aircraft and to be transmitted to the aircraft concerned by data transmission systems. This in fact assumes that the aircraft involved are equipped with suitable transmission systems; particularly accurate and reliable results for the movements of the other aircraft are obtained in this manner, however. In particular, a high accuracy of the respective positional determination is possible if the DGNSS (Differential Global Navigation Satellite System) is generally introduced.

In the event that other aircraft are not provided with corresponding devices, it is also possible for the data on other aircraft which are necessary for calculating probabilities to be obtained by direction finding or by repeated positional messages from the other aircraft (GPS squitter).

Another embodiment of the procedure according to the invention consists of only calculating the probabilities for one air space, in which the aircraft concerned can be situated within a period comprising all the selected times. The number of space elements for which occupancy probabilities are calculated is thus restricted.

To obtain an improved estimate of the flying behaviour of other aircraft, provision can be made in the procedure according to the invention for a reaction of the other aircraft to be taken into consideration by the procedure according to the invention for the calculation of the occupancy probabilities of at least one other aircraft.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
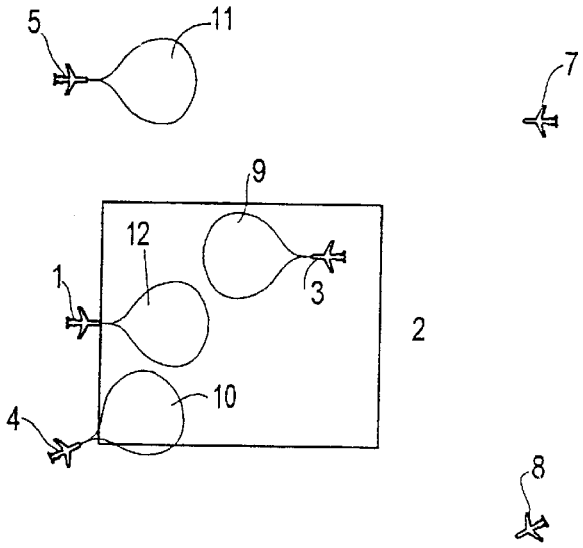
FIG. 1 is a schematic illustration of the air space with a plurality of aircraft.

The preferred embodiments of the present invention will now be described with reference to FIGS. 1–10 of the drawings. Identical elements in the various figures are designated with the same reference numerals.

The illustration shown in FIG. 1, the aircraft 1 is flying into a detection space 2 in which occupancy probabilities are calculated for the aircraft concerned 1 itself and for other aircraft; this will be described in more detail later. For this purpose, data are acquired from other aircraft, which data relate in particular to the position, speed, speed of changing course and speed of ascent/descent. If corresponding prerequisites exist, the detection space can also include the position of the aircraft concerned 1—for example when the latter is flying in a curve.

The only aircraft 3, 4, 5 which are included in the calculations are those which are at a distance from the aircraft concerned 1 for which a hazard cannot be completely ruled out taking into account the speed of approach to the aircraft concerned. Aircraft 7, 8 which are at a greater distance cannot suffer a hazardous encounter with the aircraft concerned 1 within a foreseeable time. Unless their distance from the aircraft concerned 1 is already too great for data transmission, a further inclusion in the calculation, based on the transmitted position and the actual position for these aircraft 7, 8, is omitted.

At the time considered, the aircraft 3 is situated inside the detection space 2. For part 9 of the air space, a probability distribution is calculated for the occupancy of the aircraft 3 at different times over a period of 30 to 90 seconds, for example. Shorter times are preferred when the procedure according to the invention is employed on the ground.

For an aircraft 4 which is situated outside the detection space 2, t he calculation of the occupancy probabilities gives a sub-space 10 inside e the detection space 2.

Calculation of the occupancy probabilities for aircraft 5 gives a sub-space 11 which is situated completely outside the detection space 2. Aircraft 5 is therefore completely left out of consideration. It is anticipated that the aircraft concerned 1 moves within a sub-space 12 during the predetermined time.

Sub-spaces 9 to 12 are illustrated in FIG. 1 as areas which are provided with distinct boundaries, although the probability gradually tends to 0 at a distance from locations with a high probability. This illustration has first of all been drawn for the sake of clarity, but in this respect corresponds to the actual implementation of the procedure according to the invention, since space elements with an extremely low occupancy probability are not taken into consideration for reasons of computational capacity—therefore it is only space elements with an occupancy probability above a threshold value which are taken into consideration.

Figure 2:
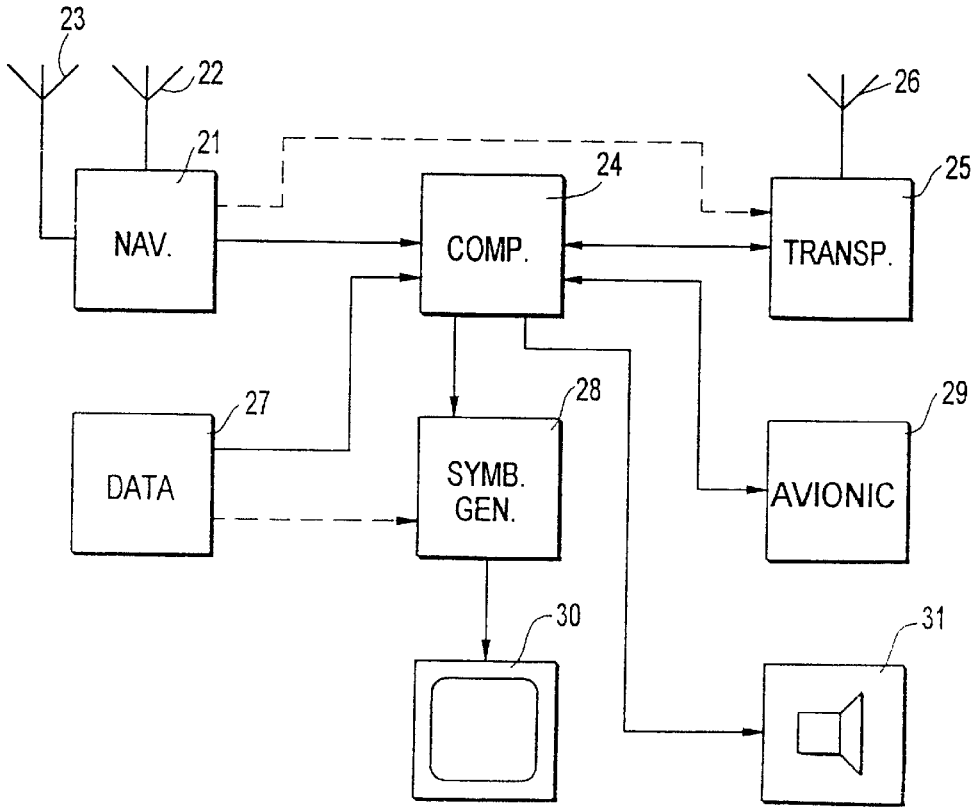
FIG. 2 is a block circuit diagram of a device for carrying out the procedure according to the invention.

The device for carrying out the procedure which is illustrated in FIG. 2 consists of a plurality of units, the function of which as such is known in principle and which are therefore not described in greater detail. A navigation unit 21 is provided with two antennas 22, 23 and receives signals from a GNS system, such as the Global Positioning System for example. Antenna 22 is designed for receiving satellite signals, whilst differential s signals for increasing the accuracy of the positional determination can be receive d via antenna 23. The navigation unit 21 also comprises other units necessary for navigation, for example a compass and an altimeter. From the data received and from the signals from the compass and the altimeter, the navigation unit calculates the position and location of the aircraft and the changes in these data, particularly the flight speed, speed of changing course and the speed of ascent/descent.

These data are fed to a main computer 24, which is connected to a transponder 25 via a bidirectional data connection. The transponder is a transmitter/receiver unit comprising one or more antennas 26 for the exchange of data with other aircraft, ground stations and vehicles. Data transmission systems of this type are known in the art and do not need to be described in greater detail in connection with the present invention. A system which is suitable for the procedure according to the invention is described in the conference volume: The International Air Transport Association, Global Navcom '94, Geneva, 18 to Jul. 21, 1994, J. Nilsson, Swedavia, "The Worldwide GNSS-Time Synchronized Self-Organising TDMA Data Link—A Key to the Implementation of Cost-Effective GNSS-Based CNS/ATM Systems".

Should it be advisable in the particular case, transmission of the data generated by the navigation unit 21, provided these are generated for transmission to other aircraft, can also be effected directly to the transponder 25.

The device illustrated also comprises a database 27 in which cartographic data on countries which are flown over are stored, amongst other information. Since the calculation of the occupancy probability of other aircraft can be made to depend on the type of the other aircraft in each case, data on relevant aircraft which are necessary for this purpose can also be stored in the database 27. Data such as these essentially describe the motivity of the aircraft, such as the maximum acceleration and the tightest curve radii, for example. The data stored in the database 27 can be retrieved by the main computer 24 according to the respective need. If the data are directly provided for graphic display by means of the display 30, they can also be fed directly to a symbol generator 28.

The main computer 24 is also connected to other computers of the avionics system 29 of the aircraft, so as to be able to interrogate data which are necessary for the calculation of occupancy probabilities and of evasive routes. An audio system for the purposes of an audio-response unit is also connected to the main computer 24.

In order to illustrate different values of occupancy probabilities, the space elements illustrated in FIGS. 3 to 7 have been cross-hatched at different densities, wherein a dense cross-hatching indicates a high occupancy probability. Space elements which are not cross-hatched have an occupancy probability which is so low that they are not taken into consideration for the output of warning indications and in the calculation of evasive routes. In the illustrations shown in FIGS. 3 to 7, it is assumed in each case that the aircraft flies into the detection space illustrated at time t0 in each case, and that the quantities which are necessary for the calculation of occupancy probabilities are measured and calculated at this time, and in the case of other aircraft are transmitted to the aircraft concerned.

For a large number of statistically distributed values and combinations of values of the flying speed, of the speed of changing course and of the speed of ascent/descent, points are calculated in each case within the detection space which receives the aircraft at selected times, namely $t=t1+n.\delta t$, wherein n is an integer and can assume values between 0 and 10, for example, whilst values between 1 and 5 seconds have been shown in trials to be favourable for $\delta t$. The calculation of occupancy probabilities and of evasive routes is performed significantly more rapidly than the continuing movement of the aircraft, so that the results can be displayed or further processed in advance.

Figure 3B:
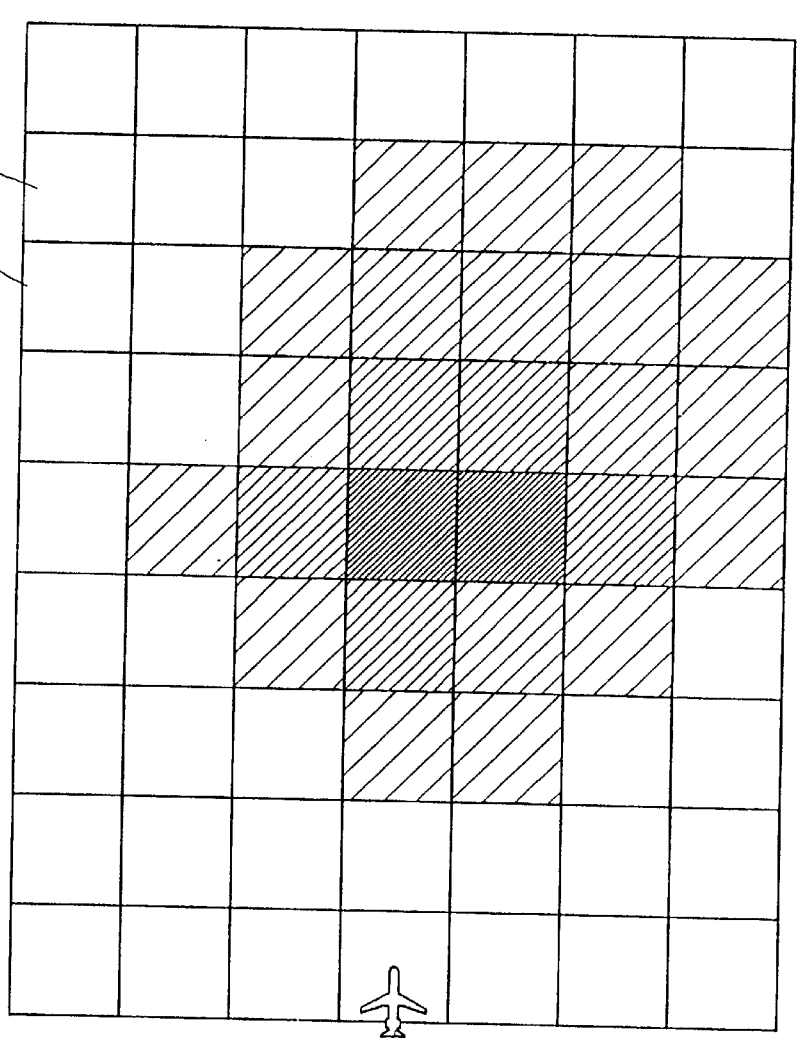
FIG. 3 is an illustration of one plane of the detection space with an aircraft and the occupancy probabilities thereof at two different times.
Figure 3A:
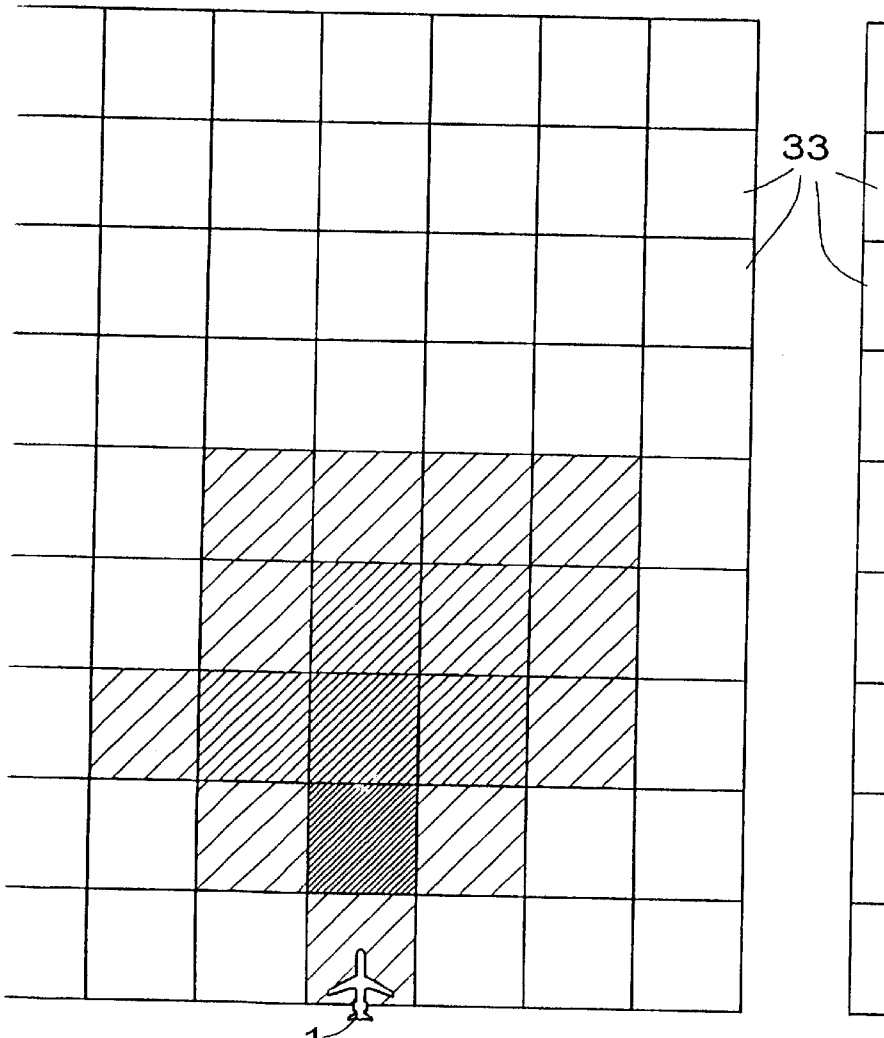

In the example illustrated in FIG. 3, the aircraft exhibits a slight trend to the right. This only enables the distribution of the occupancy probabilities at time t1 to be surmised via space elements 33 (FIG. 3*a*), but this is shown more clearly after $n.\delta t$. Moreover, due to the longer forecast period, the occupancy probabilities at the later time are distributed over a larger area as shown in FIG. 3*b*—and in actuality are therefore distributed over a larger space.

Figure 4A:
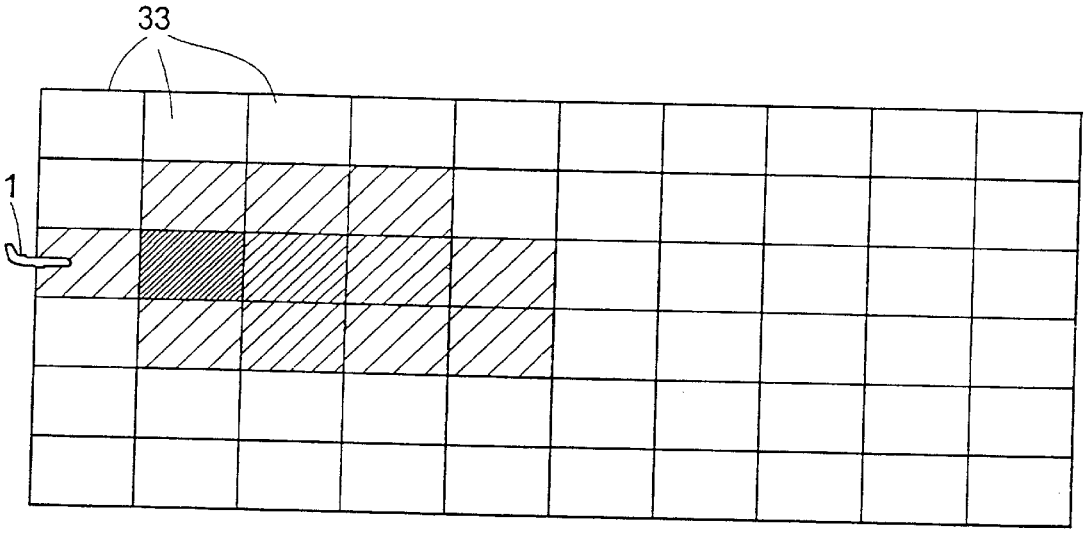
FIG. 4 is a side view of the detection space with an aircraft and the occupancy probabilities thereof at two different times.
Figure 4B:
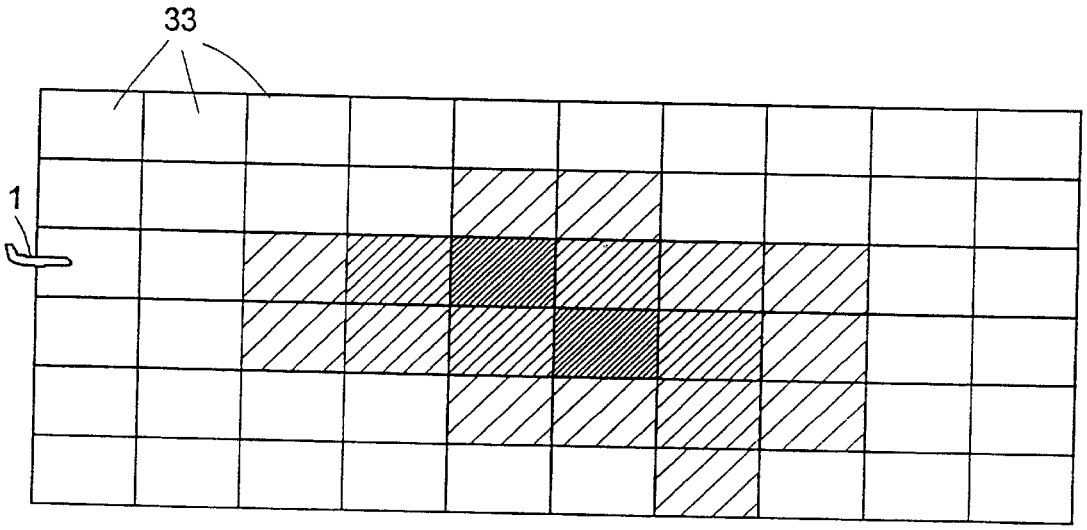

FIGS. 4*a* and 4*b* also show the occupancy probabilities at two different times in individual space elements 33, as a side view, however. Whereas the space elements are illustrated as squares in FIGS. 3*a* and 3*b*, FIGS. 4*a* and 4*b* show rectangular space elements. This takes into account the fact that the individual flight levels in aviation are situated closely one above another, so that it is necessary accurately to maintain height in controlled air lanes. In tests on the procedure according to the invention, it has therefore proved to be advantageous to select the height of the space elements in the region of about 200 m or less. The horizontal dimensions, which are preferably dependent on the flying height of the aircraft, can be about 100 m on the ground, which approximately corresponds to the size of the largest aircraft, and can be about 900 m at heights up to 10,000 feet.

From the distribution of probabilities over the space elements 33, it can be recognised that the aircraft 1 is travelling in a slightly descending flight. This is only manifested extremely slightly in the distribution of occupancy probabilities at time t=t1, but is clearly apparent at the time which is later by $n.\delta t$.

Figure 5A:
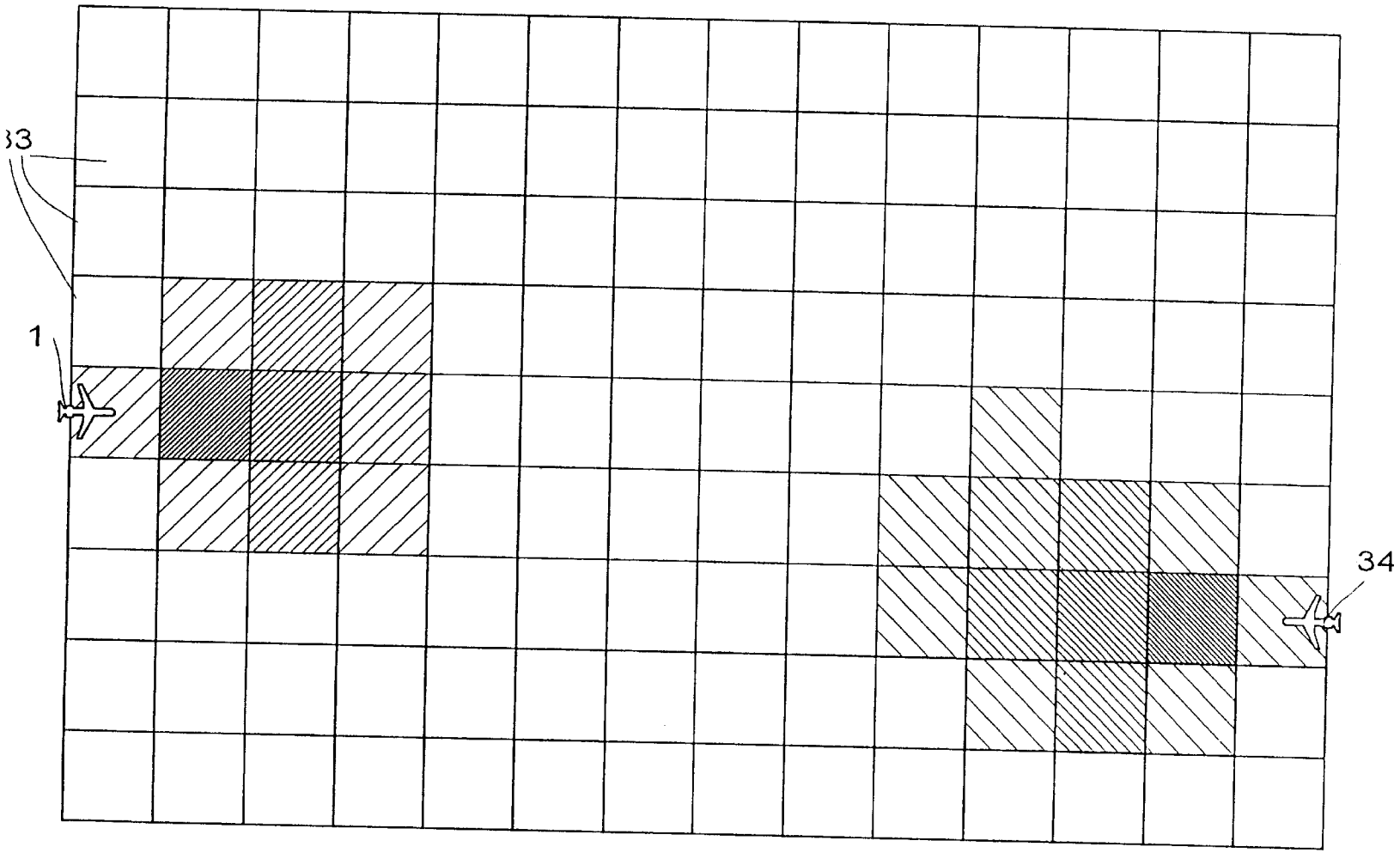
FIG. 5 shows a plane of the detection space with two aircraft and the occupancy probabilities thereof at two different times.
Figure 5B:
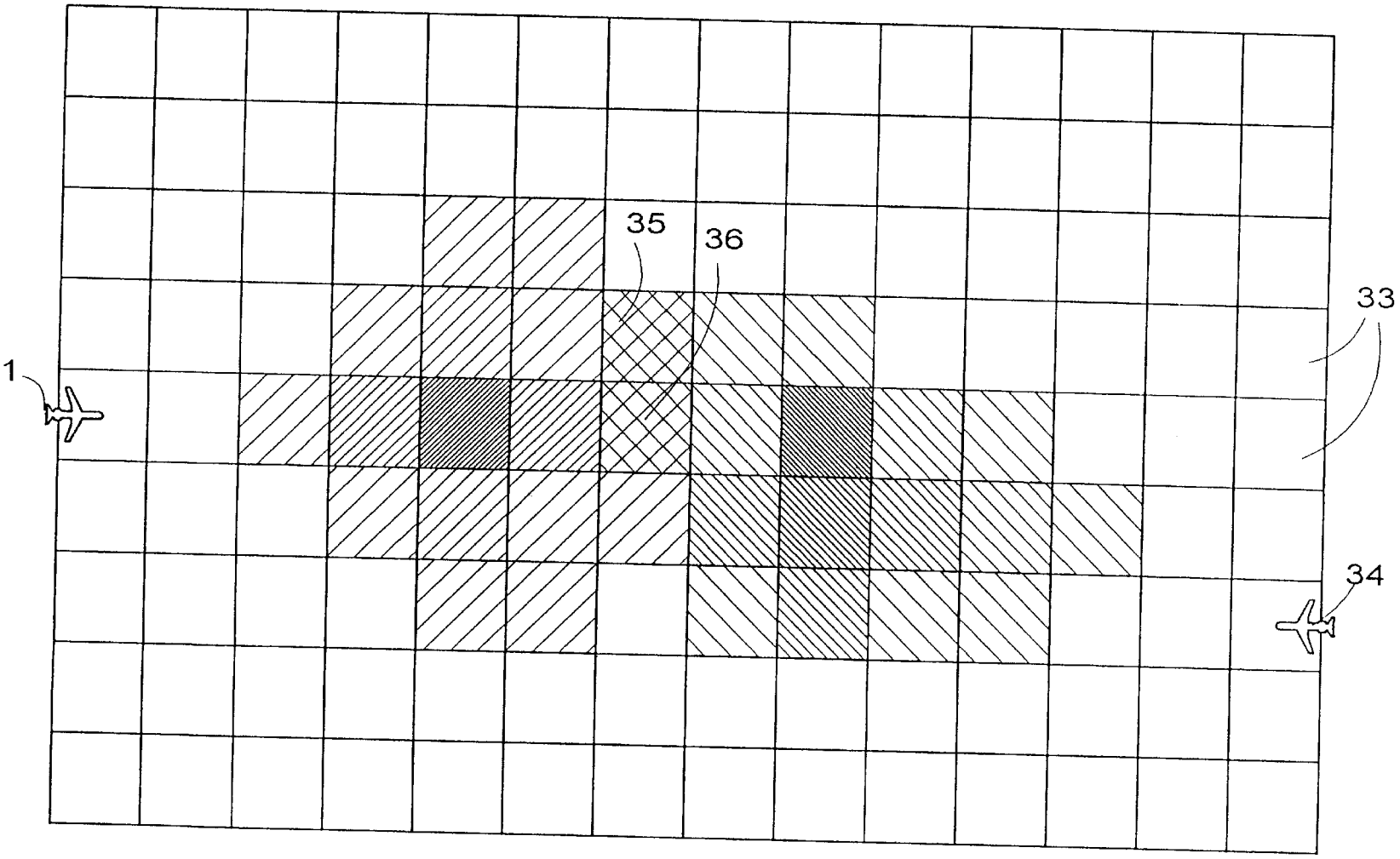

FIGS. 5*a* and 5*b* show the distributions of the occupancy probability, at two different times, of two aircraft 1, 34, which encounter each other. At time t1, the aircraft 1, 34 are at a distance such that the probability of the aircraft occupying the same space element is not taken into account. A straight flight in the direction shown by the aircraft symbol can be deduced from the distribution of occupancy probabilities of aircraft 1. However, aircraft 34 is situated in a right-hand curve which possibly intersects the flight path of aircraft 1, which is assumed to be straight. This is shown by the prediction at δt, as shown in FIG. 5*b*. At this time, the probability of both aircraft 1, 34 being situated one of the space elements 35, 36 can no longer be neglected. This can be shown on a display in a manner similar to that shown in FIG. 5*b*. The areas 35, 36 can be provided with a warning colour, for example. The occupancy probabilities which are illustrated by the different densities of cross-hatching in FIG. 5*b* can also be identified on the display, so that the pilot can select an evasive route which avoids the space elements with a high occupancy probability of the other aircraft. An automatic investigation of a proposal for an evasive route is explained below in connection with FIG. 9.

Apart from other aircraft, fixed obstacles and hazards due to weather, such as storms for example, can also be included in the procedure according to the invention.

Figure 6A:
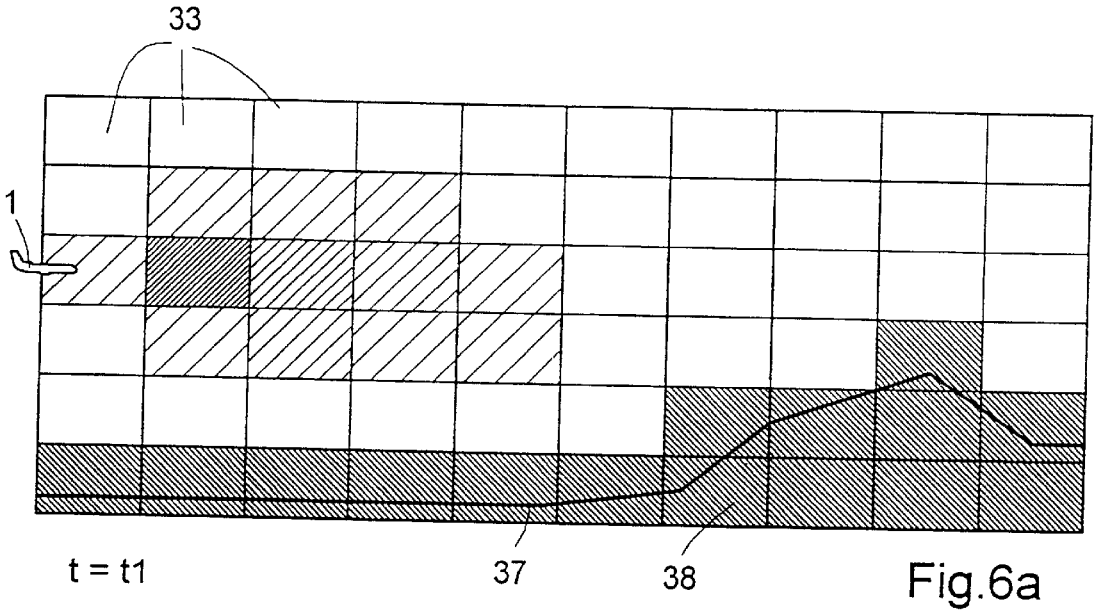
FIG. 6 is a side view of the detection space, with an aircraft and with mountainous terrain, showing occupancy probabilities at two different times.
Figure 6B:
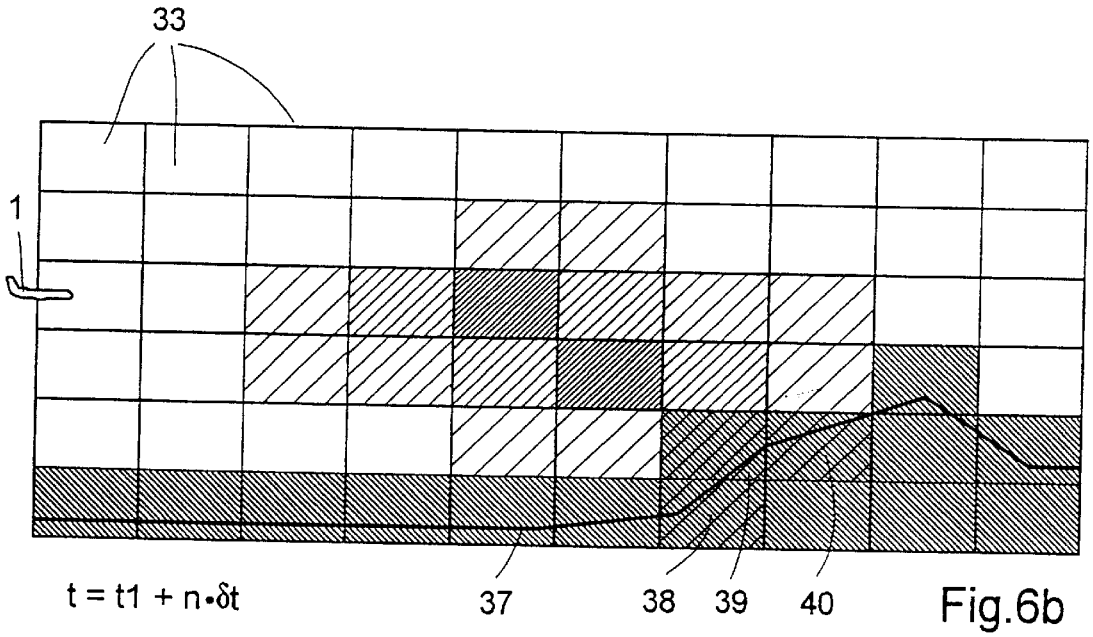

FIGS. 6*a* and 6*b* show the occupancy probabilities of an aircraft 1 as a side view at two different times. The aircraft 1 is flying over a partly flat, partly hilly terrain, which is illustrated by a line 37. Each of the space elements 38 into which the terrain at least projects are illustrated with an occupancy probability of 1. The occupancy probabilities of the aircraft 1 correspond to those in FIG. 4. At time t=t1 there are still no relevant probabilities of the aircraft being situated in space elements which are also occupied by the terrain. At time n.δt, however, this situation has altered significantly, as can be seen from the double cross-hatching of space elements 38, 39 and 40. When this situation arises, the pilot of the aircraft 1 receives a suitable warning, which consists of a display as shown in FIG. 6b, another suitable optical display or an acoustic indication.

If it is assumed that the elevation of the terrain 37 is an elevation in the form of points, so that it is possible to fly round it at the side, an evasive route recommendation from the computer will propose a change in course to the right. Alternatively, a change in course to the left, or in an emergency even a proposal to climb to a greater flying height may be made.

Figure 7A:
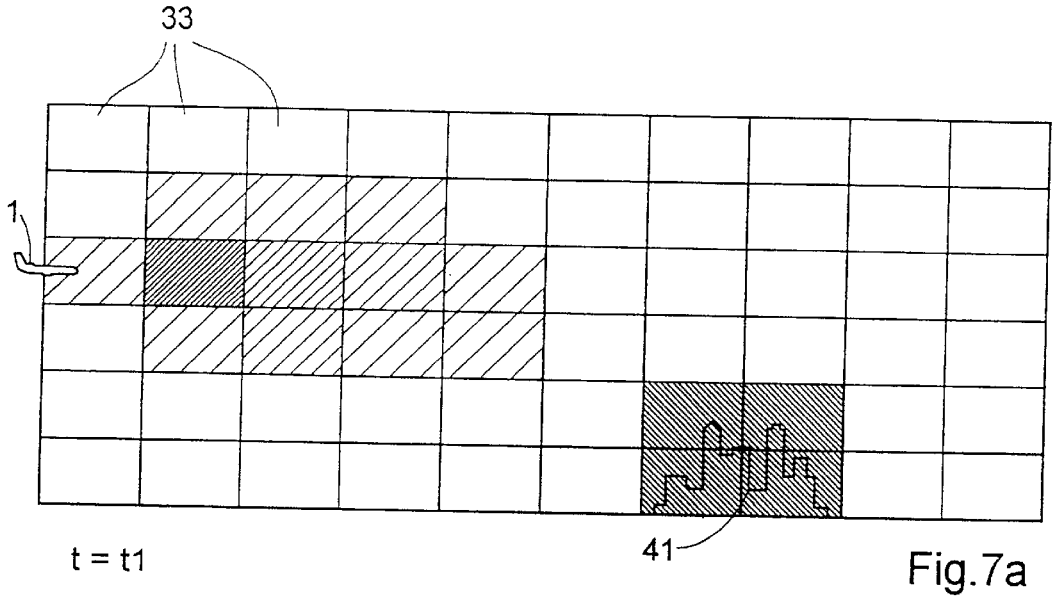
FIG. 7 shows the same flying situation as that in FIG. 6, but with buildings as the obstacle.
Figure 7B:
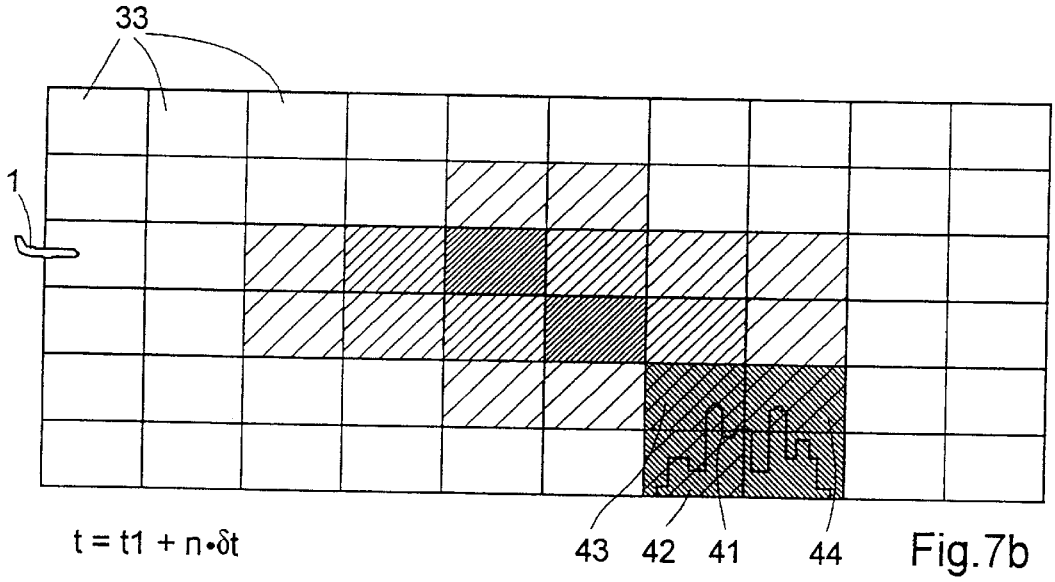

FIG. 7 illustrates the same flying situation of an aircraft 1 on its approach to an aviation obstacle 41, wherein at time t1+n.δt a probability exists, which cannot be neglected, that the aircraft 2 is situated together with the building complex in space elements 42, 43, 44. However, the buildings are lower than the elevation of the ground shown in FIG. 6, so that the recommendation to the pilot of the aircraft 1 may be that he should maintain his current flying height in each case.

Figure 8:
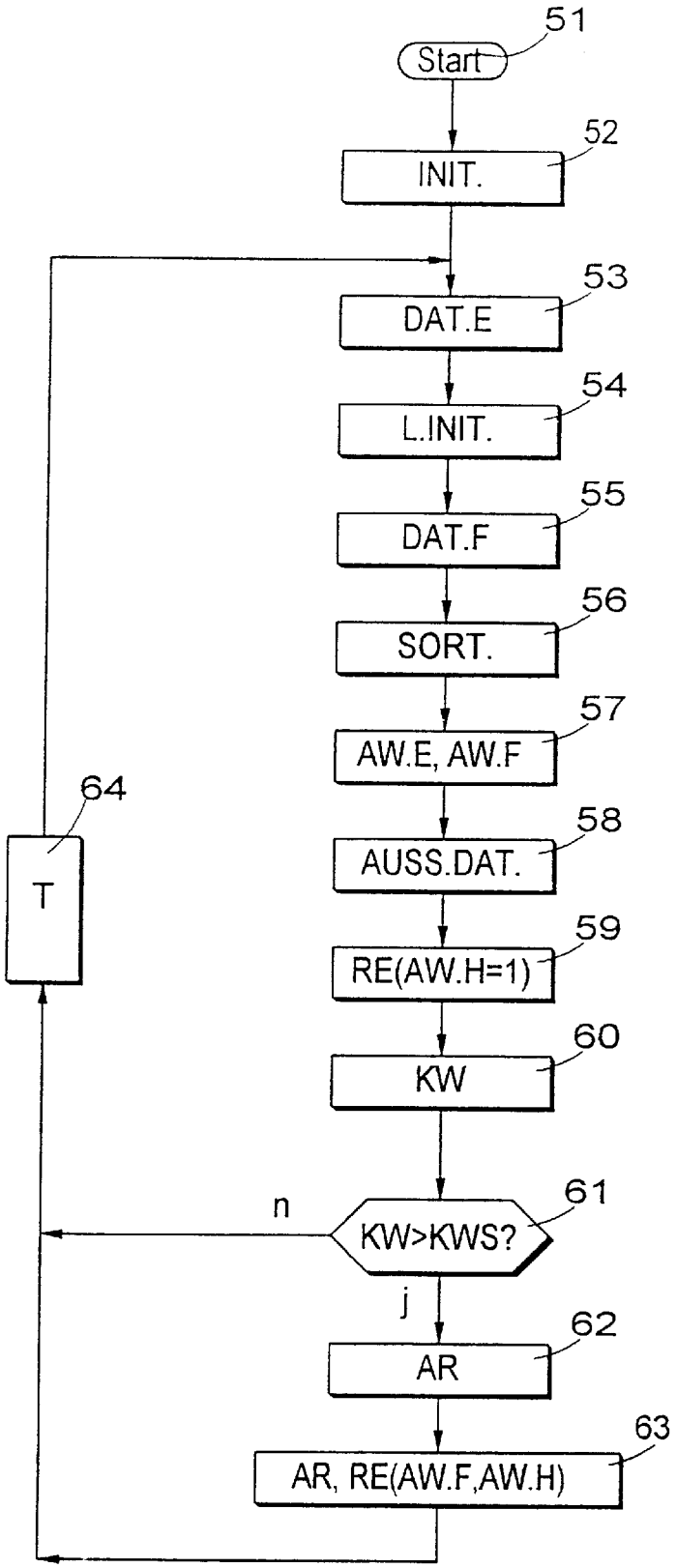
FIG. 8 is a flow diagram for explaining the procedure according to the invention.

FIG. 8 shows the course of an embodiment of the procedure according to the invention in the form of a flow diagram. Initialisation is effected at 52 after a start at 51. Thereafter, the data for the aircraft concerned, DAT.E, are read in at 53 and are converted into a separate system of coordinates comprising units which are favourable for further calculation. The air space L is initialised at 54, i.e. the detection space 2 is essentially fixed. Data from external aircraft, DAT.F, are read in and converted at 55. When the procedure according to the invention is employed on the ground, data from other vehicles such as motor vehicles and aircraft can be read in and converted here.

In program part 56 the data from external aircraft are sorted according to their "chronological" distance, wherein aircraft which are far away are excluded. This is followed, at 57, by the determination of the occupancy probabilities AW.E and AW.F of the aircraft concerned and of the aircraft which have not been excluded.

In program part 58, a portion of the database which contains the terrain and aviation obstacles is determined. For this portion, space elements which are occupied by elements of the database, namely aviation obstacles or ground elevations, and which therefore contain the occupancy probability AW.H=1, are determined at 59.

At 60, collision probabilities KW are calculated, namely probabilities with which at least one other aircraft or another object is situated simultaneously in a space element RE in each case. Thereafter, the programme branches at 61, depending on whether one of the calculated collision probabilities is greater than a predetermined value KWS. If this is the case, an evasive route AR is determined at 62, and is output at 63, optionally together with a display of the conflict area RE (AW.F, AW.H),. If this is not the case after the branching 61, the programme is repeated, starting at 53, after a predetermined time T at 64.

Figure 9:
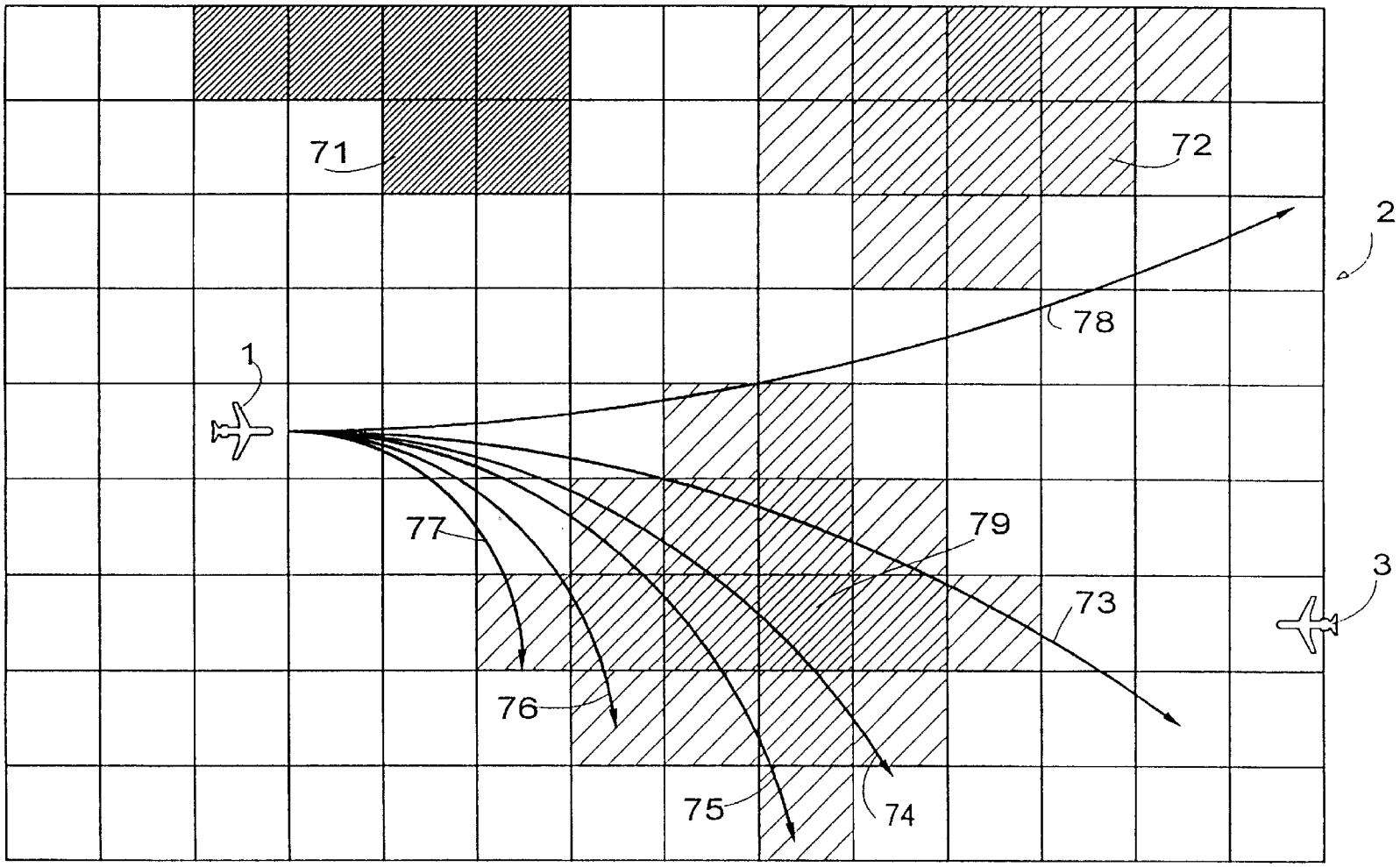
FIG. 9 is an illustration of the calculation of an evasive route.

FIG. 9 serves to provide an explanation of the determination of an evasive route, wherein the risk of a collision was identified in a previous step in that the collision probability for one or more space elements exceeds an allowable value, as is illustrated in FIG. 5*b* for space elements 35, 36 for example. FIG. 9 is a plan view of the detection space 2 for a selected height, with an aircraft concerned 1 and an external aircraft 3. A ground elevation 71 is also situated in the detection space 2; this results in six space elements being illustrated with an occupancy probability of 1. A storm 72 also protrudes into the detection space 2, the occupancy probability of which is relatively high for one space element and decreases outwards.

In addition, the occupancy probabilities of aircraft 3 are illustrated in FIG. 9, wherein a relatively high occupancy probability for aircraft 3 prevails in space element 79.

It is assumed that before the risk of a collision is identified the aircraft 1 will fly in a curve illustrated by arrow 73 without correction of its course. Corresponding to the general rules of evasion, evasive routes 74 to 76 with decreasing curve radii are calculated as a test.

Evasive route 77 constitutes an evasive manoeuvre which require a turning speed which is too high, and is therefore not proposed. For evasive route 78, a space element is flown through, the occupancy probability of which by the external aircraft 3 is still not negligible but which is below a fixed threshold which is still tolerable, so that this route may also be proposed to the pilot of aircraft 1, for example.

Figure 10:
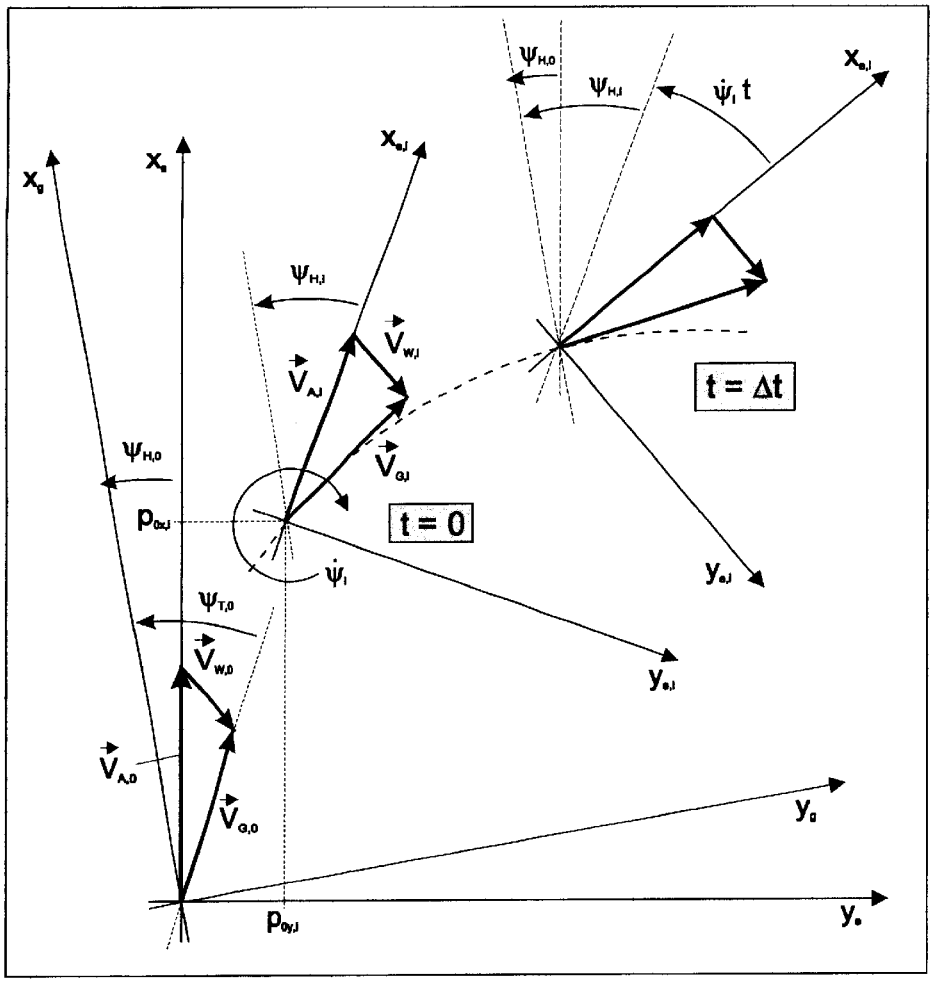
FIG. 10 is an illustration of a flight path calculation.
Figure 11:
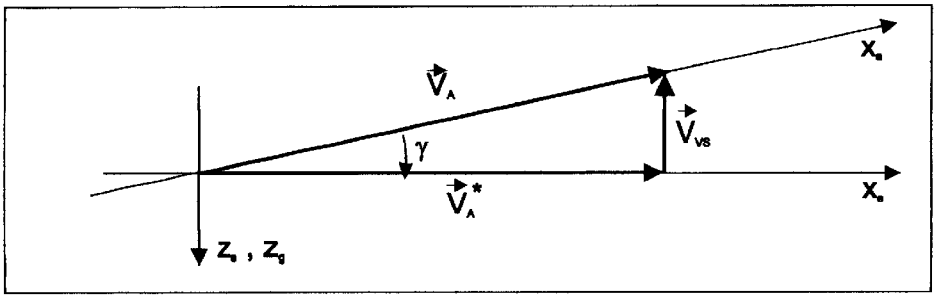

The equations of motion follow according to FIGS. 10 and 11. A system which has an xy plane which coincides with that of the geodetic system, and the x axis of which is aligned according to the course of the aircraft concerned at the starting time considered (suffix e), is selected as the spatially fixed system of coordinates for the determination of the location of the occupancy probability. When considering the motion, it is assumed that the wind vector is constant over the forecast period. Since the flying speed in relation to the air is the determining quantity for flight guidance and flight safety, it is assumed that the quantity $V_A=|\overline{V}_A|$ is only subject to slight changes, which are correspondingly modelled for the forecast. This gives the speed over the ground as a "free" quantity, which may be subject to considerable changes as regards its magnitude and direction. Thus the following equation is obtained for the $x_e y_e$ plane:

$\overline{V}_G(t)=\overline{V}_W+\overline{V}_A{}^*(t)$

The speed in relation to the air is aligned along the $x_a$ axis of the aerodynamic system of axes. When $\beta=0$, the $x_a z_a$ planes coincide with the $x_e z_e$ plane. Thus the condition $\overline{V}_A=\overline{V}_A\cdot\cos\gamma$ is applicable to the speed which is illustrated in the horizontal plane. If $\cos\gamma$ is set equal to 1, the error up to $\gamma=16°$ is less than 4%, which can be taken into account by an assumed uncertainty for $V_a$, so that the condition $$\overline{V}A^*\approx\overline{V}_A$$

is applicable to the following considerations.

The following conditional equations for the speed are firstly applicable to the e-system of each aircraft involved, where i=[0, 1 . . . , n], wherein the condition i=0 is applicable to the aircraft concerned.

$$\overline{V}_{A,i}=V_{A,i}\begin{bmatrix}1\\0\end{bmatrix}$$

$$\overline{V}_{C,i}=\begin{bmatrix}\cos(\psi_{H,i}-\psi_{T,i}) & \sin(\psi_{H,i}-\psi_{T,i})\\ -\sin(\psi_{H,i}-\psi_{T,i}) & \cos(\psi_{H,i}-\psi_{T,i})\end{bmatrix}\begin{bmatrix}V_{G,i}\\0\end{bmatrix}$$

$$\overline{V}_{W,i}=V_{G,i}\begin{bmatrix}\cos(\psi_{H,i}-\psi_{T,i})\\ -\sin(\psi_{H,i}-\psi_{T,i})\end{bmatrix}-V_{A,i}\begin{bmatrix}1\\0\end{bmatrix}=\begin{bmatrix}V_{Wx,i}\\V_{Wy,i}\end{bmatrix}$$

The speed vectors $\overline{V}_{A,i}$, $\overline{V}_{W,i}$ have to be transformed into the system of e-coordinates of the aircraft concerned which are fixed for the prediction. The following equations are applicable:

$$\overline{V}^{(e)}_{A,i}=V_{A,i}\begin{bmatrix}\cos(\psi_{H,0}-\psi_{H,i})\\ -\sin(\psi_{H,0}-\psi_{H,i})\end{bmatrix},\quad \text{for } t=0$$

$$\overline{V}^{(e)}_{W,i}=\begin{bmatrix}\cos(\psi_{H,0}-\psi_{H,i}) & \sin(\psi_{H,0}-\psi_{H,i})\\ -\sin(\psi_{H,0}-\psi_{H,i}) & \cos(\psi_{H,0}-\psi_{H,i})\end{bmatrix}\begin{bmatrix}V_{Wx,i}\\V_{Wy,i}\end{bmatrix},$$

$$\text{with}\quad \overline{V}^{(e)}_{W,i}\neq\hat{f}(t).$$

wherein the course angles are not a function of time, but represent the course angles at the start of the period considered.

The movement of the aircraft during the prediction is determined by the variable quantities $\overline{V}_A$, $\overline{V}_{VS}$, $\Psi^*$ and by the wind vector, the magnitude and direction of which are assumed to be constant. Due to the change in course based on $\overline{\Psi}^*$, the flying speed vector is rotated, so that the following time-dependent conditional equation is obtained for $\overline{V}_{A,i}{}^{(e)}$:

$$\overline{V}^{(e)}_{A,i}(t)=V_{A,i}\begin{bmatrix}\cos(\psi_{H,0}-\psi_{H,i}-\psi_i^*t)\\ -\sin(\psi_{H,0}-\psi_{H,i}-\psi_i^*t)\end{bmatrix}$$

Accordingly, the following equation is obtained in the e-system for the speed over the ground $$\overline{V}_{G,i}{}^{(e)}(t)=\overline{V}_{W,i}{}^{(e)}+\overline{V}_{A,i}{}^{(e)}(t)$$

The change in position in the $x_e y_e$ plane can then be determined according to $$\Delta\overline{P}^{(e)}_i(t)=\int_0^t\overline{V}^{(e)}_{G,i}(\tau)\,d\tau$$

With $\Delta\Psi_{H,i}=\Psi_{H,0}-\Psi_{H,i}\approx f(t)$, the following equations are obtained for the x and y components:

$$\Delta P^{(e)}_{x,i}(t)=\int_0^t(V^{(e)}_{Wx,i}+V_{A,i}\cos(\Delta\psi_{H,i}-\psi_i^*\tau))\,d\tau$$

$$\Delta P^{(e)}_{y,i}(t)=\int_0^t(V^{(e)}_{Wx,i}-V_{A,i}\sin(\Delta\psi_{H,i}-\psi_i^*\tau))\,d\tau$$

The simple relationship $$\Delta P^{(e)}_{z,i}(t)=\int_0^t-V_{VS,i}\,d\tau$$

is applicable to the z component.

With the aid of the known addition theorem for trigonometric functions, the integral equations lead to the conditional equations for the change in position. The initial conditions then give the three equations for positional determination, wherein the condition $\Delta\Psi_{H,i}=0$ is applicable to the aircraft concerned.

$$p^{(e)}_{x,i}(t)=V^{(e)}_{Wx,i}\cdot t+\frac{V_{A,i}\cdot\cos(\Delta\psi_{H,i})}{\psi_i^*}\cdot\sin(\psi_i^*\cdot t)+\frac{V_{A,i}\cdot\sin(\Delta\psi_{H,i})}{\psi_i^*}\cdot(1-\cos(\psi_i^*\cdot t))+p^{(e)}_{0x,i}$$

$$p^{(e)}_{y,i}(t)=V^{(e)}_{Wy,i}\cdot t-\frac{V_{A,i}\cdot\sin(\Delta\psi_{H,i})}{\psi_i^*}\cdot\sin(\psi_i^*\cdot t)+\frac{V_{A,i}\cdot\cos(\Delta\psi_{H,i})}{\psi_i^*}\cdot(1-\cos(\psi_i^*\cdot t))+p^{(e)}_{0y,i}$$

$$p^{(e)}_{z,i}(t)=-V_{VS,i}\cdot t+p^{(e)}_{0z,i}$$

The determination of the location of the occupancy by an aircraft is characterised by a series of uncertainties. Depending on the navigation devices and methods used, accuracies in positional determination of less than one metre to several kilometres are achieved. For the following considerations, it is assumed that all the aircraft involved are equipped with navigation systems which achieve the following accuracies for positional determination:

| | | |
|---|---|---|
| For the cruising flight, or flying height above FL | sigma xy < 100 m | sigma z < 30 m |
| For all other flight sections | sigma xy < 30 m | sigma z < 30 m |
| For all movements on the ground | sigma xy < 3 m | detection on ground |

Additional uncertainties arise for the prediction of the location of the occupancy, due to atmospheric effects and the control inputs of the pilot of the aircraft or of an autopilot. Moreover, the dimensions of the aircraft, which for jumbo jet aircraft are of the order of 70 m for the length and width (wing span), also have to be taken into consideration—particularly for movements on the ground. Therefore, for the determination of the risk of a collision the location of the occupancy is not important in the sense of a point in Euclidean space, but as a probability with which the object concerned occupies a discrete sub-volume of the air space.

For this purpose, the air space L situated around the aircraft to be considered is subdivided into discrete space elements. The extent of the air space is thus dependent on the speed the manoeuvring potential and the flying phase of the aircraft. L has the dimensions $$L:[1..n_x]\times[1..n_y]\times[1..n_z]$$

The air space thus consists of $n_x.n_y.n_z$ space elements. Apart from the introduction of space elements in the form of right parallelepipeds, it is also possible to introduce space elements in the form of segments of spherical shells or hexahedrons which generate an identical volume for each sub-element. In order to be able to determine the risk of a collision, the occupancy probability of all the objects in question then has to be determined for each space element L. A procedure for this purpose is explained below.

As given in the equations for positional determination, the location $\overline{p}(t)$ which an aircraft reaches at a defined time is dependent on the flying speed $V_A$, on the vertical speed $V_{VS}$ and on the turning speed $\Psi^*$. These speeds may be subject to changes over the forecast period, so that significant deviations occur in relation to the location which results from a consideration based on flight mechanics. Whereas the flying speed—apart from during take-off and landing—is mostly only subject to slight changes in speed, the turning speed can change considerably within seconds, such as when a curved flight is initiated for example.

In order to take random influences into consideration, probability functions for the three said speeds are introduced instead of constant speeds for the calculation of the location of the occupancy, due to which $\overline{p}(t)$ is no longer a determinant quantity. A symmetrical, triangular probability function is inherently possible. The speed at the initial time $t_0$ of the period considered thus has the highest probability, and then falls to zero to the right and to the left over an interval to be defined. However, if the aircraft is moving close to a maximum or minimum speed, a symmetrical triangular distribution results in high probabilities for speeds which cannot occur due to physical flying conditions. Moreover, a symmetrical distribution can only reproduce conservative behaviour, i.e. of a change in the instantaneous speed having a low probability, to an inadequate degree. A probability density has therefore proved useful for which the probabilities in the vicinity of the maximum fall off steeply to both sides, and fall less steeply and unsymmetrically in their further progression.

The aircraft is assumed to be moving at a flying speed $V_0$ at time $t_0$. The probability $p_c$ that this speed will be maintained within the time frame considered is the highest, and thus constitutes the maximum of the probability density function f(x). The high gradient within the interval $V_b \leqq x \leqq V_t$ represents conservative behaviour. The probability p continuously falls towards the limiting speeds $V_{min}$, $V_{max}$, and outside the interval $V_{min} \leqq x \leqq V_{max}$ is given by p=0. The probability function, which is defined in six sections, is defined as follows by the parameters described above:

$$f(x) = \{$$

$$0 \qquad x < V_{\min} \tag{1}$$

$$\frac{p_h}{V_b - V_{\min}}(x - V_{\min}) \qquad V_{\min} \le x < V_b \tag{2}$$

$$\frac{p_c - p_b}{V_c - V_b}(x - V_b) + p_b \qquad V_b \le x < V_c \tag{3}$$

$$-\frac{p_c - p_t}{V_t - V_c}(x - V_c) + p_c \qquad V_c \le x < V_t \tag{4}$$

$$-\frac{p_t}{V_{\max} - V_t}(x - V_t) + p_t \qquad V_t \le x \le V_{\max} \tag{5}$$

$$0 \qquad x > V_{\max} \tag{6}$$

$$\}$$

In the above expressions, $V_{min}$ and $V_{max}$ are the minimum and maximum flying speeds, $V_c$ is the speed with the highest probability, and $V_b$ and $V_t$ are the speeds at the transitions between a steep and a less steep fall.

The definition of f(x) is valid for $V_t \leqq V_{max}$ and $V_b \leqq V_{min}$. If $V_t > V_{max}$, section (5) of the definition is inapplicable and section (4) is valid for $V_c \leqq x \leqq V_{max}$. The same applies to the situation when $V_c$ approaches $V_{min}$. The distribution function is given by $$F(x) = \int_{-\infty}^{x} f(u)\,du.$$

Integration section by section gives the conditional equations for F(x).

$$F(x) = \{$$

$$0 \qquad x < V_{\min} \tag{1}$$

$$\frac{p_h}{2(V_b - V_{\min})}(x - V_{\min})^2 \qquad V_{\min} \le x < V_b \tag{2}$$

$$\frac{p_c - p_b}{2(V_c - V_b)}(x - V_b)^2 + p_b x - p_b V_b + s_1 \qquad V_b \le x < V_c \tag{3}$$

$$\frac{p_t - p_c}{2(V_t - V_c)}(x - V_c)^2 + p_c x - p_c V_c + s_1 + s_2 \qquad V_c \le x < V_t \tag{4}$$

$$-\frac{p_t}{2(V_{\max} - V_t)}(x - V_t)^2 + p_t x - p_t V_t + s_1 + s_2 + s_3 \qquad V_t \le x \le V_{\max} \tag{5}$$

$$1 \qquad x > V_{\max} \tag{6}$$

$$\}$$

The quantities $s_i$ give the partial areas under f(x).

In order to determine the position of an aircraft the random variable x, which gives a speed at time $t_0+\Delta t$, has to be determined. If the random variable is extracted n times, n new positions can be determined from the equations of motion given above. The probability of the aircraft occupying a defined sub-space of the air space L at time $t_0+\Delta t$ can thus be determined.

In addition to the current speed $V_c$, the quantities $V_{max}$ and $V_{min}$ are determined by the configuration of the aircraft. The probability function is determined by the choice of $V_b$ and $V_t$ and of the ratio $p_c/p_t$ with $p_b=p_t$. Thus the anticipated dynamics of motion of an aircraft can also be depicted by a suitable choice of these quantities. If a small value is selected for $p_c|p_t$, considerable changes in speed can be expected within the time frame considered. In contrast, a large value of $p_c/p_t$ results in the conservative behaviour mentioned above.

Since computers generally only provide random variables with a rectangular distribution (R[0,1]), the determination of the random variables should be effected by means of the inversion method. According to this method, a variable y such as F is distributed if y is determined according to $$y=F^{-1}(u),$$

wherein u is an R[0,1] distributed random variable. The determination of the inversion function for the function, which proceeds strictly monotonically section by section, results in a quadratic equation for each section which can easily be solved by means of the pq formula. The conditional equations for the four sections of the inversion function are as follows:

| p | q | |
|---|---|---|
| $-2\,V_{min}$ | $V_{min}^2-\frac{2y}{p_b}(V_b-V_{min})$ | (2) |
| $2\cdot\left(\frac{p_b(V_c-V_b)}{p_c-p_b}-V_b\right)$ | $V_b^2+2\frac{V_c-V_b}{p_c-p_b}\cdot(s_1-y-p_bV_b)$ | (3) |
| $2\cdot\left(\frac{p_c(V_t-V_c)}{p_t-p_c}-V_c\right)$ | $V_c^2+2\frac{V_t-V_c}{p_t-p_c}\cdot(s_1+s_2-y-p_cV_c)$ | (4) |
| $-2\,V_{max}$ | $V_t^2+2\frac{V_{max}-V_t}{p_t}\cdot(s_1+s_2+s_3-y-p_tV_t)$ | (5) |

The random variable is thus calculated from $$x=-\frac{p}{2}\pm\sqrt{\frac{p^2}{4}-q}$$

The random variable for sections (2) and (3) is obtained by the addition of the square root term; for (4) and (5) it is obtained by subtraction. Thus a sufficiently large number of extractions of an R[0,1] distributed random variable results in a distribution which is advantageous for the procedure according to the invention.

There has thus been shown and described a novel method of detecting a collision risk and preventing air collisions which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method for identifying a risk of a collision in aviation between an own aircraft and other objects, wherein the airspace is divided into a plurality of contiguous space elements, each having a prescribed volume, comprising the steps of:

(a) calculating probabilities, for the own aircraft, that the own aircraft is situated in predetermined space elements at a plurality of selected times (occupancy probabilities); and (b) from the occupancy probabilities of the own aircraft and the occupancy probabilities of at least one other object in the vicinity of the own aircraft, calculating the probabilities of the simultaneous occupancy by the own aircraft and the other object (collision probabilities) for the predetermined space elements at the selected times.

2. The method according to claim 1, further comprising the step of graphically displaying on a display device the space elements with the occupancy probability of the own aircraft and that of the other objects which are calculated each time.

3. The method according to claim 2, wherein space elements for which the collision probability exceeds a predetermined value are displayed in emphasized form.

4. The method according to claim 1, further comprising the step of calculating an evasive route to avoid collisions and displaying such route for the own aircraft if the probability of the simultaneous occupancy of at least one space element by the own aircraft and by said at least one other object exceeds a predetermined value.

5. The method according to claim 4, wherein a plurality of evasive routes are calculated, with an excursion which increases from evasive route to evasive route, as a test in accordance with recognized or determined evasive rules, wherein the calculated evasive route which gives a probability of a hazardous encounter below a predetermined threshold value at the smallest excursion is selected and displayed or is converted into a control command, and wherein, when a limiting excursion is reached without the probability of a hazardous encounter being correspondingly reduced, evasive routes in another direction are calculated.

6. The method according to claim 1, wherein the other objects are other aircraft and wherein occupancy probabilities are calculated for other aircraft situated within a relevant distance.

7. The method according to claim 1, wherein the other objects are fixed objects on the ground which are taken into consideration with an occupancy probability of one for the display of the space elements and/or for the calculation of evasive routes.

8. The method according to claim 1, wherein the space elements are in the form of right parallelepipeds.

9. The method according to claim 1, wherein the size of the space elements is variable and wherein the size increases with increasing flying height of the own aircraft.

10. The method according to claim 9, wherein the size of the space elements is varied within three classes, namely the smallest space elements for taxiing on the ground, medium space elements for flying heights less than 10,000 feet, and large space elements for greater flying heights.

11. The method according to claim 1, wherein the occupancy probabilities are calculated from the respective position, course and course over the ground of the own aircraft from the flying speed and the speed over the ground, from the speed of changing course and from the speed of ascent/descent and wherein a multiplicity of calculations is performed with variations of the flying speed, of the speed of changing course and of the speed of ascent/descent.

12. The method according to claim 11, wherein the values of the flying speed, of the speed of changing course and of the speed of ascent/descent which are assumed for the calculation of occupancy probabilities are statistically varied, and wherein for each of these variations counters are incremented for those space elements in which the own aircraft is situated at the selected times.

13. The method according to claim 1, wherein the probabilities are calculated from the respective position, course and course over the ground of the own aircraft, from the flying speed and from the speed over the ground, from the speed of changing course and from the speed of ascent/descent, wherein measures are also put into effect for the statistical scatter of the flying speed, of the speed of changing course and of the speed of ascent/descent, so that at each selected time a statistical distribution of the positions of the own aircraft is calculated, and wherein the statistical distributions are converted into occupancy probabilities in individual space elements.

14. The method according to claim 6, wherein the data on other aircraft which are necessary for the calculation of the occupancy probabilities are measured in the other aircraft and are transmitted to the own aircraft by a data transmission system.

15. The method according to claim 6, wherein the data on other aircraft which are necessary for calculating the probabilities are obtained by direction finding from the own aircraft.

16. The method according to claim 6, wherein the data on other aircraft which are necessary for the calculation of the probabilities are obtained by repeated transmission of position messages from the other aircraft to the own aircraft.

17. The method according to claim 1, wherein the occupancy probabilities are only calculated for one air space, in which the own aircraft can be situated over a period comprising all the selected times.

18. The method according to claim 6, wherein a reaction of at least one other aircraft is taken into consideration for the calculation of the occupancy probabilities of the other aircraft.

* * * * *